United States Patent [19]

Wiley, Jr. et al.

[11] 4,082,630

[45] Apr. 4, 1978

[54] ELECTROLYTIC CELL BRINE FEED SYSTEM

[75] Inventors: A. C. Wiley, Jr.; Otis C. Taylor, both of Lake Jackson, Tex.

[73] Assignee: The Dow Chemical Company, Midland, Mich.

[21] Appl. No.: 572,542

[22] Filed: Apr. 28, 1975

[51] Int. Cl.[2] ..... C25B 1/16; C25B 1/26; C25B 15/08

[52] U.S. Cl. ..... 205/98; 204/128; 204/257; 204/263

[58] Field of Search ..... 204/98, 101, 95, 94, 204/257, 258, 263, 266, 267, 269, 275, 278, 128

[56] References Cited

U.S. PATENT DOCUMENTS

| | | | |
|---|---|---|---|
| 2,183,299 | 12/1939 | Stuart | 204/266 |
| 2,669,122 | 2/1954 | Silby, Jr. | 204/275 X |
| 3,598,707 | 8/1971 | Bergeron et al. | 204/266 X |

OTHER PUBLICATIONS

Hampel, "The Encyclopedia of Electrchemistry", Reinhold Publish, (1964), pp. 176–179.

Lowenstein, "Design So Solids Can't Settle Out", Chem. Engin., Jan. 12, 1959.

*Primary Examiner*—Arthur C. Prescott

*Attorney, Agent, or Firm*—Robert W. Selby

[57] ABSTRACT

An electrolytic cell system wherein an alkali metal chloride is electrolized to produce chlorine and alkali metal hydroxide in a diaphragm-type cell by feeding an aqueous slurry of an alkali metal chloride particulate to an anode compartment of the cell through at least one primary conduit and then a secondary conduit at a linear velocity of at least 6.5 feet per second. The secondary conduit has an interior cross-sectional area up to about 0.2 square inch and less than that of the primary conduit. By means of the described feed system, substantially uniform quantities of the aqueous slurry can be substantially simultaneously and continuously fed to a plurality of anode compartments.

10 Claims, 2 Drawing Figures

ELECTROLYTIC CELL BRINE FEED SYSTEM

BACKGROUND OF THE INVENTION

This invention pertains to the production of chlorine in an electrolytic cell and more in particular to an electrolytic cell system with an improved means of feeding an alkali metal chloride to an electrolytic cell.

When operating a diaphragm-type electrolytic cell to produce chlorine and an alkali metal hydroxide, an alkali metal chloride is generally supplied to or fed into the anode compartment of the cell as an aqueous solution of the alkali metal chloride, such as sodium chloride. To attain optimum recoveries and maximize efficiency of certain diaphragm type electrolytic cells, it is oftentimes desirable to maintain the sodium chloride concentration in the anolyte at near saturation levels. This has been found to be difficult since electrolysis depletes the aqueous anolyte solution of sodium and chlorine ions, thereby increasing the water content and reducing the concentration of the sodium chloride.

It has heretofore been proposed that fine particles of sodium chloride be added to the anolyte to maintain a relatively high sodium chloride concentration within the anode compartment. U.S. Pat. Nos. 1,388,466; 1,388,474 and 1,423,584 describe various means to add solid sodium chloride salt to a chlorine producing electrolytic cell.

Whenever a solid salt is added to an electrolytic cell, over-saturation of the anolyte must carefully be avoided to prevent precipitation of solid salt within the anode compartment and deposition of solid salt on or within the diaphragm. The diaphragm, and thus the electrolytic cell, will become inoperative or at least highly inefficient if the diaphragm becomes plugged due to the deposition of salt particles therein.

An apparatus and method are desired which will permit operation of an alkali metal chloride concentration in the anolyte at near-saturation levels without resulting in oversaturation of the anolyte with the salt, thereby causing deposition of salt in the diaphragm, or deposition of solid salt within conduits leading to the anode compartment.

SUMMARY OF THE INVENTION

The apparatus and method of the present invention provide a satisfactory means of supplying or feeding a finely divided solid, aqueous alkali metal chloride slurry to an anode compartment of an electrolytic cell without either causing deposition of the solid salt within conduits leading to the anode compartment or adversely affecting the cell performance by substantial over-saturation of the anolyte with the salt. Such over-saturation generally results in plugging of a diaphragm separating the anode and cathode compartments with a solid salt.

The electrolytic cell system of the present invention includes an electrolytic cell with an anode and a cathode positioned in respective anode and cathode compartments. The anode and the cathode compartments are spaced apart from each other by a diaphragm suited to pass at least alkali metal ions from the anode compartment to the cathode compartment. A suitable means is provided to remove gaseous chlorine from the anode compartment. Alkali metal hydroxide formed in the cathode compartment during electrolysis is removed by a suitable means. Sufficient electrical energy is supplied to the anode and cathode to electrolyze the alkali metal chloride to form gaseous chlorine at the anode and alkali metal hydroxide at the cathode by suitable well known means.

The improvement of the present invention includes a means adapted to feed an aqueous slurry of the alkali metal chloride particulate to the anode compartment through at least one primary conduit and then through a secondary conduit at a linear velocity of at least about 6.5 feet per second. The secondary conduit has an interior cross-sectional area of up to about 0.2 square inch and less than that of the primary conduit.

In operation of the described electrolytic cell system improvement, an aqueous slurry containing solid alkali metal chloride particulate is fed through the primary conduit and then through the secondary conduit into the anode compartment. The linear flow of the brine through the conduits is controlled at a linear rate of at least about 6.5 feet per second. By maintaining the secondary conduit interior cross-sectional area of up to about 0.2 square inch combined with the slurry linear flow rate of at least about 6.5 feet per second, the deposition of solid salt within, and plugging of, the conduit system leading to the anode compartment is minimized.

DESCRIPTION OF THE DRAWING

The accompanying drawing further illustrates the present invention.

DESCRIPTION OF THE PREFERRED EMBODIMENTS

Figures 1, 2:
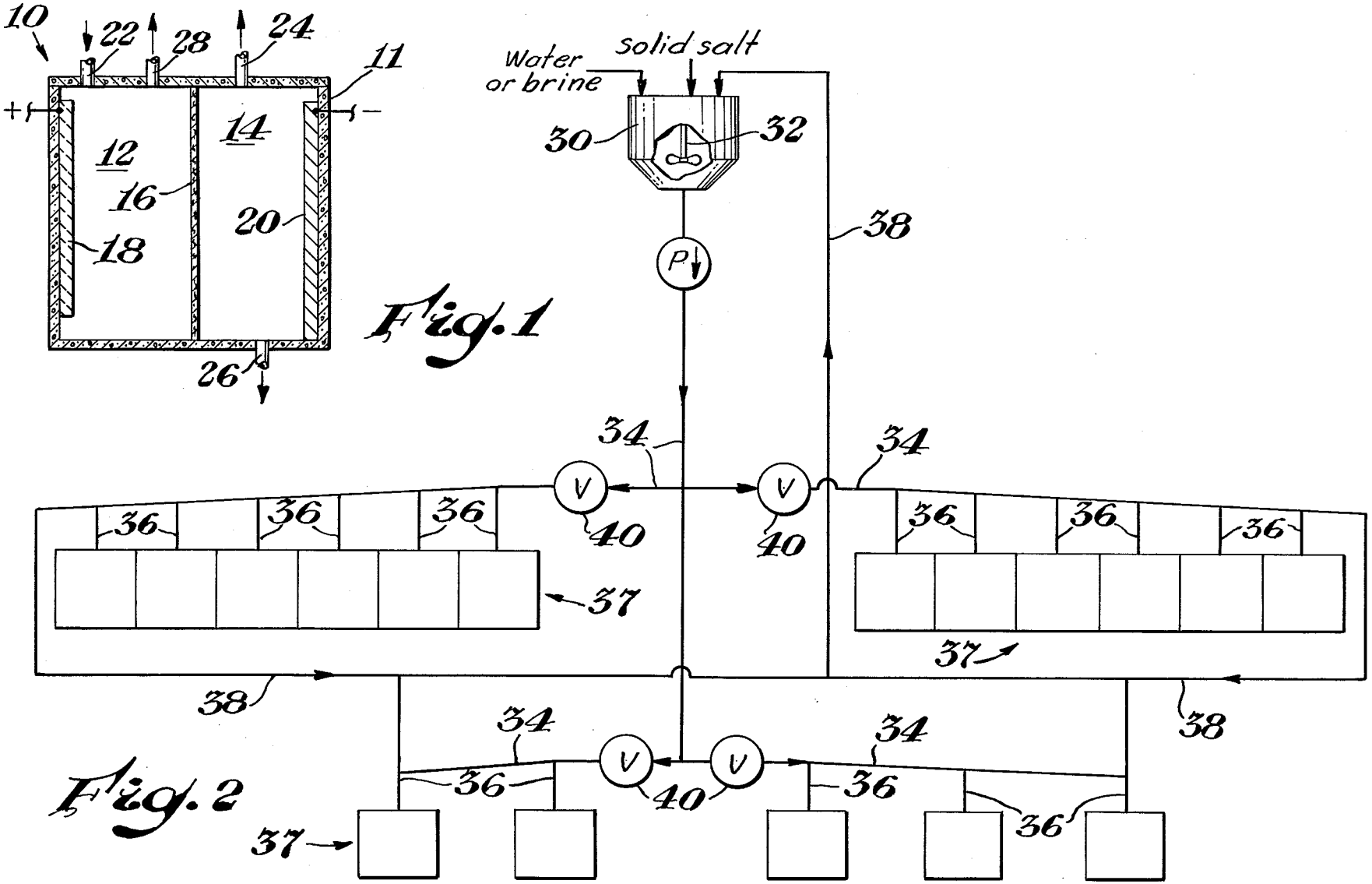
In FIG. 1 is a cross-section of a basic electrolytic cell for producing chlorine and an alkali metal chloride.
In FIG. 2 there is schematically illustrated one embodiment of the improved electrolytic cell system of the invention.

The electrolytic cell of the present invention is capable of utilizing various alkali metal chloride salts; however, sodium chloride is preferred and will be referred to hereinafter without limiting the scope of the invention. Referring now to FIG. 1 of the drawing, a cross-sectional view of a single electrolytic cell 10 is shown which is illustrative of the remaining cells shown schematically in the drawing. The electrolytic cell has a cell body 11 substantially entirely encasing an anode compartment 12 which is spaced apart from a cathode compartment 14 by an ion permeable diaphragm 16.

As is well known, the diaphragm 16 can be constructed from an asbestos material or a cation exchange membrane. Cation exchange membranes are well known to contain fixed anionic groups that permit intrusion and exchange of cations, and exclude anions, from an external source. Generally the resinous cation exchange membrane or diaphragm has as a matrix a cross-linked polymer, to which are attached charged radicals such as $-SO_3^-$, $-COO^-$, $-PO_3^{--}$, $-HPO_2^-$, $-AsO_3^{--}$and $-SeO_3^-$. Vinyl addition polymers and the condensation polymers may be employed. The polymer can be, for example, styrene, divinylbenzene, polyethylene and phenolsulfuric acid and formaldehyde resins. A method of preparing such resinous materials is described in U.S. Pat. No. 3,282,875.

An anode 18 is disposed within the anode compartment 12. The anode 18 may be made of carbon or of a metal, such as tungsten or tantalum, coated with well known activating materials such as platinum or ruthinium or compounds thereof. A cathode 20 constructed of a material resistent to the corrosive effects of sodium hydroxide, such as steel, is disposed within the cathode compartment 14. The anode 18 and the cathode 20 are electrically attached to a suitable electric supply means (not shown).

The electrolytic cell 10 further includes a gaseous chlorine removal means, such as a pipe 22, to afford removal of chlorine gas without substantial loss of chlorine to the ambient atmosphere. Likewise, when hydrogen gas is formed in the cathode compartment 14, a means to remove the hydrogen from the cathode compartment 14 is provided by, for example, conduit or pipe 24. Sodium hydroxide formed in the cathode compartment 14 can be withdrawn from the compartment 14 through a suitable means such as conduit or pipe 26. Naturally, the particular location of the various means to remove the products of the electrolytic process or to feed an aqueous sodium chloride slurry into the anode compartment through a conduit 28 are not critical to the invention and may be altered as desired.

In operation of the aqueous slurry feed means of FIG. 2, finely divided sodium chloride particles are fed into a mixing container 30 together with water, and/or an alkali metal salt containing brine, and, optionally, aqueous salt slurry which was not passed into the anode compartments to be electrolyzed. The water-salt feed is suitably mixed to form a generally uniform slurry composition by means of, for example, an impeller 32 in the container 30. The slurry flows from the container 30 into first and second primary conduits or pipes 34 and then into secondary conduits 36, which are physically connected to the anode compartments (not shown) within the cell series 37. The respective lengths of the secondary conduits 36 between the primary conduits 34 and the anode compartments can be suitably adjusted to provide a substantially uniform volume of slurry through the secondary conduits in a unit time period. A shorter secondary conduit length results in a greater slurry flow than does a longer secondary conduit, when the pressure within the primary conduit 34 is maintained constant.

It has been found that the slurry can be passed into the anode compartments on a substantially continuous basis without plugging the diaphragm when the secondary conduit 36 has a cross-sectional area of up to about 0.2 square inch. Preferably the secondary conduit 36 is a tube with an inside diameter of from about three-sixteenths to about five-sixteenths inches. It is essential that the primary conduits 34 have a cross-sectional area greater than that of the secondary conduits 36. Preferably each position of the primary conduit 34 has an interior cross-sectional area at least equal to the total interior cross-sectional areas of the secondary conduits 36 fed from that portion of the primary conduit. Generally the primary conduit 34 will be a pipe with an inside diameter of from about 1 one-half to about 3 inches.

That portion of the aqueous slurry which is not passed into the electrolytic cells 10 through the secondary conduits 36 from the primary conduits 34 can be returned to the mixing container 30 through a return conduit or pipe 38.

The feed rate of the slurry into the electrolytic cells 10 is controlled solely by means of the pressure within the primary conduits 34 and the length of the secondary conduits 36. It is unnecessary and undesirable to control the flow of the aqueous slurry into individual anode compartments by means of valves, since physical restrictions in the conduit system or other valve-type flow control means has a tendency to plug when controlling a slurry feed. Should it be desired or necessary to control the flow to an entire series, a suitable control valve 40 can, optionally, be physically connected into the primary conduits 34 at appropriate locations.

In operation of the electrolytic cell system, an aqueous sodium chloride slurry containing up to about 20 weight percent sodium chloride particulate is passed through the primary conduits 34 at a linear velocity of at least about 6.5 and preferably from about 7 to about 10 feet per second. More preferably, the sodium chloride particulate is present in an amount of from about 5 to about 10 weight percent of the aqueous slurry. The sodium chloride particles in the slurry are of a sufficient size to pass through the primary and secondary conduits and will generally be of a size up to about 100 mesh and preferably from about 250 to about 100 mesh (U.S. Standard Sieve Size). It is apparent that the slurry passed into the various anode compartments is a saturated solution of sodium chloride containing an excess of sodium chloride as solid particles.

As is apparent from the drawing, the present invention is employable in various types of electrolytic cells for producing chlorine; however, it is preferred that the cells of the present invention be electrically connected in series.

The hereinafter examples will further illustrate the invention.

EXAMPLE 1

A plurality of electrolytic cells, electrically connected in series, for producing gaseous chlorine and sodium hydroxide from a aqueous sodium chloride solution was operated by feeding a sodium chloride brine containing finely divided solid sodium chloride particles to anode compartments within the series. The brine was mixed with sodium chloride particles with a size of about 100 mesh by means of an impeller in a mixing container spaced apart from the electrolytic cells. The mixture or slurry contained about 5 weight percent solid sodium chloride particles.

The slurry was pumped at a pressure of 40 pounds per square inch (guage) to anode compartments within the series through corrosion resistant feed pipes with an inside diameter of about 1 ½ to 2 inches and polytetrafluoroethylene tubes with an inside diameter of three-sixteenths inch. The linear velocity of the slurry through the primary conduit was about 6.7 feet per second. Substantially the same volume of slurry was fed to each of the anode compartments by suitably adjusting the length of the tubes extending to the anode compartments from the feed pipes.

The electrolytic cell was operated by established procedures to produce chlorine and sodium hydroxide. With the slurry feed rate to the anode compartments adjusted to provide an amount of sodium chloride feed substantially equal to that being electrolyzed, there was no evidence of detrimental deposition of solid salt within the slurry feed conduit system or plugging of the diaphragms. Excess slurry in the feed pipes was returned to the mixing container and recirculated through the system.

EXAMPLES 2–5

Substantially as described in Example 1, aqueous slurries containing finely divided sodium chloride particles are pumped through the primary conduit at velocities of 7, 8, 9 and 10 feet per second without encountering precipitation of sufficient solid salt in the conduit to cause plugging of the conduit sysyem.

What is claimed is:

1. In a process to produce chlorine and an alkali metal hydroxide in an electrolytic diaphragm cell system by feeding an alkali metal chloride containing brine to an anode compartment and passing alkali metal ions through the diaphragm into a cathode chamber, supplying sufficient electrical energy to an anode positioned in the anode compartment and to a cathode positioned in the cathode compartment to release gaseous chlorine at the anode and form an alkali metal hydroxide in the cathode compartment, and recovering the chlorine and alkali metal hydroxide, the improvement comprising suitably adjusting the lengths of secondary conduits connected to the anode compartment to feed a substantially uniform volume of an aqueous slurry containing an alkali metal particulate through each of the secondary conduits in a unit time period; feeding the slurry through at least one primary conduit and then through the secondary conduits into the anode compartment, the secondary conduits having an interior cross-sectional area of up to about 0.2 square inch and less than the interior cross-sectional area of the primary conduit; and controlling the flow of the slurry through the primary and the secondary conduits at a linear velocity of at least about 6.5 feet per second.

2. The improvement of claim 1 wherein the linear velocity of the slurry through the primary conduit is from about 7 to about 10 feet per second.

3. The improvement of claim 1 including controlling the solid portion of the slurry at up to about 20 weight percent of the slurry.

4. The improvement of claim 1 including controlling the solid portion of the slurry at from about 5 to about 10 weight percent of the slurry.

5. The improvement of claim 1 including controlling the alkali metal particulate size at up to about 100 mesh.

6. The improvement of claim 1 wherein the alkali metal chloride is sodium chloride and including the additional steps of controlling the solid portion of the slurry at from about 5 to about 10 weight percent of the slurry, controlling the sodium chloride particle size at up to about 100 mesh and controlling the linear velocity of the slurry through the primary conduit at from about 7 to about 10 feet per second.

7. The improvement of claim 1 wherein the slurry is continuously fed into the anode compartments.

8. The improvement of claim 1 including returning any excess slurry in the primary conduit to a slurry mixing container.

9. The improvement of claim 1 wherein the alkali metal chloride is sodium chloride.

10. The improvement of claim 9 including the additional steps of controlling the solid portion of the slurry at from about 5 to about 10 weight percent of the slurry, controlling the sodium chloride particle size at up to about 100 mesh and controlling the linear velocity of the slurry through the primary conduit at from about 7 to about 10 feet per second.

* * * * *